United States Patent [19]

Peveto

[11] 4,280,397

[45] Jul. 28, 1981

[54] HYDRAULIC FLUID CONTROL APPARATUS

[75] Inventor: John E. Peveto, Houston, Tex.

[73] Assignee: Joy Manufacturing Company, Pittsburgh, Pa.

[21] Appl. No.: 900,545

[22] Filed: Apr. 27, 1978

[51] Int. Cl.[3] ..... F15B 13/042

[52] U.S. Cl. ..... 91/452; 91/449; 137/596.12

[58] Field of Search ..... 91/449, 451, 450, 452; 137/596.13, 596.2, 596.12; 173/164; 81/57.11, 57.19

[56] References Cited

U.S. PATENT DOCUMENTS

| | | | |
|---|---|---|---|
| 3,561,542 | 2/1971 | Hanson et al. | 173/1 |
| 3,659,655 | 5/1972 | Gyongyosl | 173/1 |
| 3,719,236 | 3/1973 | Smith, Jr. et al. | 81/57.14 X |
| 3,719,237 | 3/1973 | Flick | 81/57.14 |
| 3,732,887 | 5/1973 | Hayner | 91/433 |
| 3,766,944 | 10/1973 | Distler | 137/625.6 |
| 3,774,726 | 11/1973 | Bredberg | 91/451 X |
| 3,799,200 | 3/1974 | Tipton | 137/625.6 |
| 3,815,477 | 6/1974 | Ailshie et al. | 137/596.13 X |
| 3,823,784 | 7/1974 | Feucht | 173/1 |
| 3,903,787 | 9/1975 | Krath | 91/462 |
| 3,934,742 | 1/1976 | Tennis | 137/596 X |
| 3,976,097 | 8/1976 | Brakel | 137/596.13 |
| 4,006,783 | 2/1977 | Granholm | 173/12 |
| 4,089,169 | 5/1978 | Miller | 137/596.13 |
| 4,125,040 | 11/1978 | True | 81/52.5 |

FOREIGN PATENT DOCUMENTS

| | | | |
|---|---|---|---|
| 2261626 | 6/1973 | Fed. Rep. of Germany | 137/596.13 |
| 372378 | 4/1973 | U.S.S.R. | 91/449 |

*Primary Examiner*—Irwin C. Cohen
*Attorney, Agent, or Firm*—Arnold B. Silverman

[57] ABSTRACT

The hydraulic fluid control apparatus has velocity control means and pressure control means. The apparatus has hydraulic fluid entry means for receiving hydraulic fluid and hydraulic fluid discharge means for supplying pressurized hydraulic fluid to hydraulic power means such as an hydraulically actuated oil well drill string power tong. The velocity control means is operatively associated with the hydraulic fluid entry means and serves to establish a desired predetermined velocity for the hydraulic fluid. The pressure control means is operatively associated with the hydraulic fluid discharge means for selectively limiting the exit pressure of the hydraulic fluid through the discharge means to predetermined levels. The pressure control means includes valve means adapted to divert pressurized fluid from the hydraulic fluid discharge means when the hydraulic fluid pressure exceeds predetermined levels. Valve control means are provided for selectively setting the position of the valve means to establish a said predetermined level.

In another embodiment digital means are provided to receive an electrical signal from a transducer which emits such a signal proportional to the hydraulic fluid pressure. The signal emitted by the digital means is provided to a comparator which compares the signal with predetermined sets points and emits a signal to divert pressurized hydraulic fluid from the hydraulic fluid discharge means when the pressure therein exceeds predetermined levels.

2 Claims, 4 Drawing Figures

HYDRAULIC FLUID CONTROL APPARATUS

BACKGROUND OF THE INVENTION

1. Field of the Invention

This invention relates to hydraulic fluid control means and more specifically, relates to means for controlling speed and torque of an hydraulically actuated power means, such as power tongs employed in oil well drilling.

2. Description of the Prior Art

Power tongs rotating casing, tubing and pipe in connection with oil well drilling have been known in the art and manufactured in various forms by a number of manufacturers. In employing rotary power tongs and other hydraulic power means it is necessary to provide for a supply of hydraulic fluid at the desired pressure and velocity so as to produce the desired tong speed and torque. It is particularly important that effective controls be provided in a power tong in order to make sure that the proper tight joints are provided in drill string makeup while avoiding damage to the threads of the casings, tubes, pipes and couplings so to facilitate break-out of the threaded connections and reuse of the components.

It is also important that the hydraulic control system be such as to be dependable, economical to manufacture, easy to maintain and readily operable in a reliable fashion by the operator in the field.

SUMMARY OF THE INVENTION

The above described need has been met by the present invention by providing hydraulic fluid control apparatus which effectively controls the pressure and velocity of the hydraulic fluid supplied to hydraulic power means such as power tongs. This is accomplished in such fashion that effective pressure control which serves to control the torque applied by the tong may be established for various phases of the drill string makeup so as to avoid excessive torque at any individual stage. In one preferred embodiment, a first pressure control is adapted to control run-in torque, a second control is adapted to control minimum make-up torque and a third maximum make-up torque. The apparatus is designed to be employed with a wide range of drill string variables including pipe diameter, pipe length and thread, for example.

It is the object of the present invention to provide hydraulic fluid control apparatus which effectively controls the pressure and flow rate of hydraulic fluid supplied to hydraulic power means.

It is another object of this invention to provide hydraulic fluid control apparatus which is adapted to provide hydraulic fluid to power tongs employed in oil well drilling in such fashion as to effectively control the speed and torque applied to the tong during make-up and break-out of the threaded connections.

It is a further object of the present invention to provide such a system which is economical to manufacture and use.

It is yet another object of this invention to provide such a system wherein the operator may readily accomplish the desired make-up or break-out operation in simple fashion while establishing effective joints and avoiding undesired damage to the drill string threads.

These and other objects of this invention will be more fully understood and appreciated from the following detailed description of the invention on reference to the illustrations appended hereto.

DESCRIPTION OF THE PREFERRED EMBODIMENTS

Figure 1:
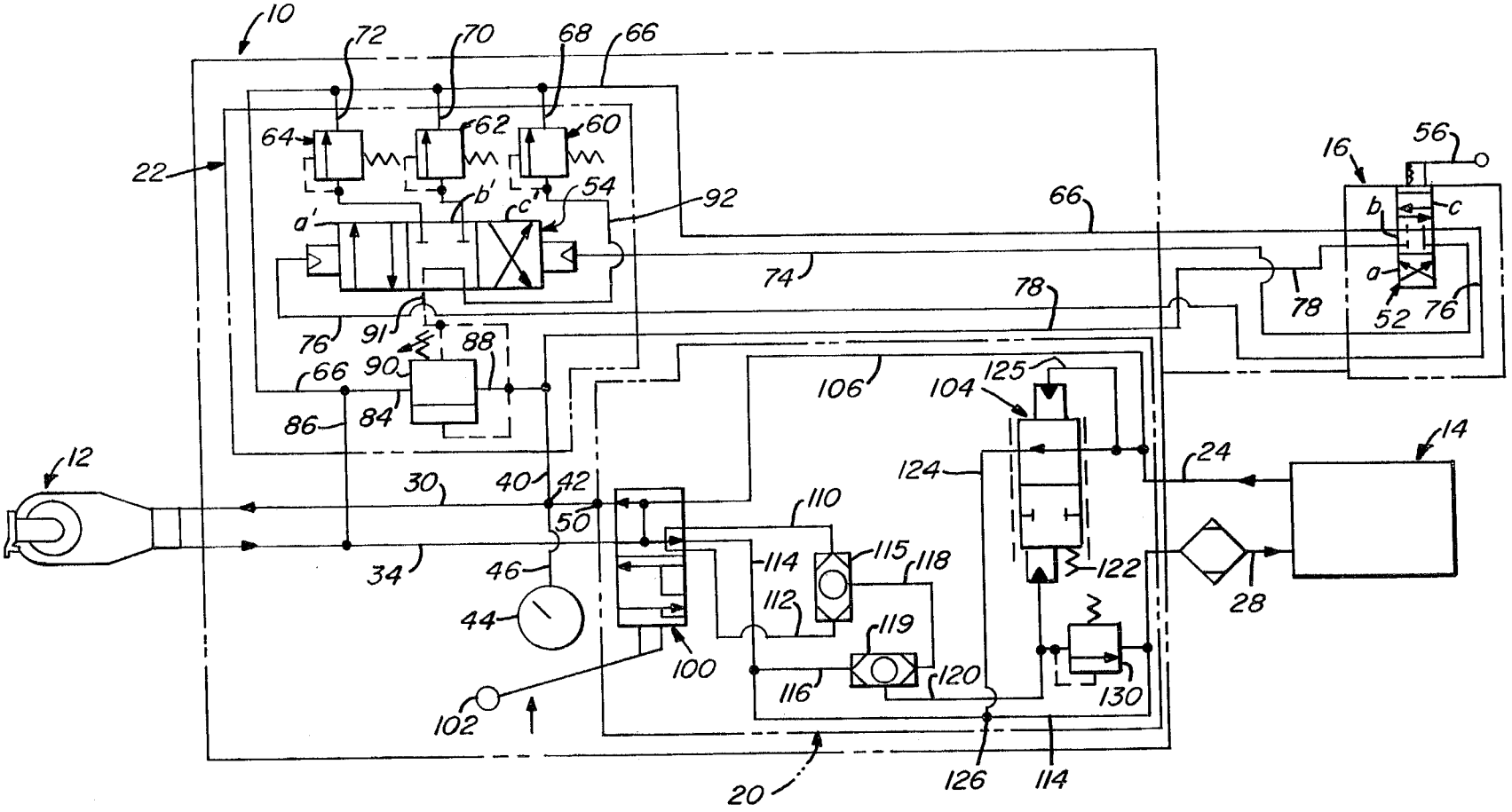
FIG. 1 is a schematic diagram of one form of hydraulic fluid control apparatus of the present invention.

Referring now to FIG. 1 there is shown an embodiment of the hydraulic fluid control apparatus 10 which, in the form shown, is controlling a power tong 12 of the type used in oil well drilling. A reservoir 14 for storing the hydraulic fluid and an operator control station 16 are also provided. The velocity control means (indicated as being enclosed by the dotted block 20) and pressure control means (indicated generally by the dotted block 22) are contained within the hydraulic fluid control apparatus 10. Pressurized hydraulic fluid is delivered from reservoir 14 through line 24 which extends into the velocity control means 20 which serves as the hydraulic fluid entry means for receiving fluid from the reservoir 14. Line 28 serves to return hydraulic fluid from the reservoir 14 from the hydraulic fluid control apparatus 10. Line 30 serves as the hydraulic fluid discharge means which delivers hydraulic fluid at the desired velocity and pressure to the power tong 12 and line 34 serves as the hydraulic fluid return means which receives hydraulic fluid from the power tong 12.

The pressure control means 22 is connected to return line 34 by line 86. The pressure control means 22 is connected to the hydraulic fluid supply means 30 by line 40 at point 42. A pressure gauge 44 is connected to point 42 by line 46 so as to give a visual indication of the hydraulic fluid pressure in line 30 at point 42. In operation of the system, hydraulic fluid will emerge from the velocity control means 20 at point 50 at a predetermined velocity. It is noted that this velocity at point 50 is at a flow position upstream from point 42.

Considering now the pressure control means 22 in greater detail it is noted that the operator control station 16 is provided with a three position manually operated valve 52 which is operatively associated with three position hydraulically operated valve 54. In operating the pressure control means 22 the operator employs operating lever 56 to place the manual valve 52 in one of three positions a, b, c in order to effect corresponding positioning of the hydraulically operated three position valve 54 in positions a', b' or c'.

A series of relief valves 60, 62, 64 are operatively associated with hydraulically actuated three position valve 54 and also with line 66. In a preferred embodiment of the present invention, each of the valves 60, 62, 64 will be adapted to be set within particular pressure ranges which are at least slightly different from one of the others. For example, in connection with use with power tongs the valve 60 can be set anywhere in the range from about 50 to 3,000 psi so as to accommodate run-in torque, valve 62 may set anywhere in the range of about 200 to 6,000 psi so as to accommodate minimum make-up torque and valve 64 may be adjustable anywhere in the range of about 200 to 6,000 psi. For example, the first valve may be set at a pressure corresponding to a desired run-in torque of about 350 foot pounds. Valve 62 may be set at a pressure corresponding to a torque of about 1,100 to 45,000 foot pounds and valve 64 may be set at a pressure corresponding to about 1,700 to 45,000 foot pounds. The torque desired and as a result the associated pressure will vary with pipe diameter, thread configuration and other conventional parameters. It will be noted that valve 60 is connected to line 66 through line 68, valve 62 is connected to line 66 by line 70 and valve 64 is connected to line 66 by line 72. When the predetermined pressure level for triggering a particular valve 60, 62, 64 is exceeded these lines 68, 70, 72, respectively, will be employed to deliver hydraulic fluid to line 66 which in a fashion which will be described hereinafter results in the hydraulic fluid being returned to reservoir 14.

In the position shown in FIG. 1, line 74 provides pressurized hydraulic fluid to operate valve 54 and is connected with one side of valve 54 and one side of valve 52. Line 76 serves as a return line for valve 54 to return hydraulic fluid from valve 54 to valve 52. Lines 74, 76 provide the hydraulic connection which serves to effect a corresponding change in valve 54 when the position of valve 52 has been altered from its neutral position.

In the form shown in FIG. 1 both valves 52, 54 are in respective positions "b", "b' ". In this position which is the valve's neutral position, there is no fluid flowing to valve 54 on line 74 and all of the fluid in line 76 is transferred to dump line 66. Were valve 52 in position "a", pressurized fluid flowing in line 78 would be transferred through the valve to line 76 to maintain valve 54 in position "a' ". Were valve 52 in position "c" the pressurized fluid in line 78 would be passed to line 74 in order to change the position of valve 54 to position "c' " and the fluid exhausted from valve 54 would pass by means of line 76 to valve 52 and into dump line 66.

Relief valve 90 is connected between dump line extension 84 and high pressure line 88 which in turn is connected to line 78. Line 86 connects the dump line 66 with hydraulic fluid return line 34. In the event that the pressure in line 88 exceeds the setting or triggering pressure of valve 90 fluid will be permitted to flow into line 84 to line 86.

Figure 2:
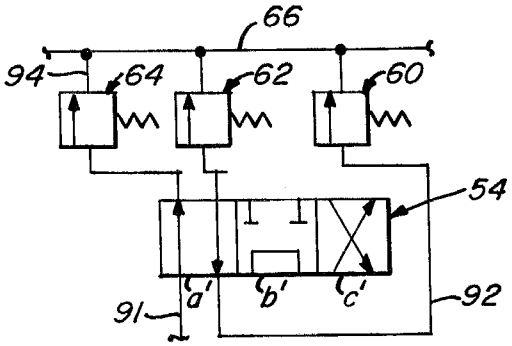
FIG. 2 is a form of valve means employed in the embodiment shown in FIG. 1 showing the valve in a different position from that shown in FIG. 1.

Referring now one again to valve 54, in FIG. 1 it is shown in the "b' " position. In this position, pressurized fluid in line 88 will pass through valve section "b' " and by means of line 92 will enter relief valve 60. In this position which may be considered the valve's neutral position hydraulic fluid will be discharged to dump line 66 only in the event the predetermined pressure setting in valve 60 has been exceeded. In the context of the use with tongs, this might be likened to the run-in pressure. Referring now to to FIG. 2, there is illustrated valve 54 in position a' as is there shown, the high pressure line 91 delivers pressurized fluid to valve 64 which if its set point is exceeded will then deliver the pressurized hydraulic fluid through line 94 to dump line 66. Also in this position "a' " fluid may be permitted to drain from valve 62 through valve 54 and line 92 into valve 60.

Figure 3:
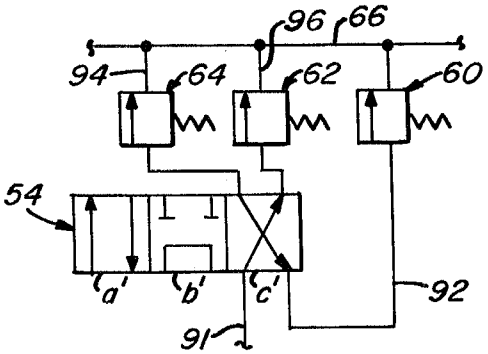
FIG. 3 illustrates a form of valve means illustrated in FIG. 1 showing the valve in a different position from that shown in FIGS. 1 or 2.

Referring now to FIG. 3 there is shown valve 54 in position "c'". In this position the high pressure fluid from 91 will enter valve 62 and if its predetermined pressure setting has been exceeded will then pass through line 96 into dump line 66. Also, fluid is permitted to pass from valve 64 through valve 52 and line 92 into valve 60.

Turning now to the velocity control means 20 and referring once again to FIG. 1 there is shown a spool valve 100 which is continuously variable by means of manually operable lever 102. The velocity control means also has an unloading valve 104. Pressurized hydraulic fluid is received within the hydraulic fluid control apparatus 10 by entry means which in the form shown is merely a continuation of pipe 24. A major portion of the pressurized fluid is carried along line 106 to valve 100 which controls the output velocity of the pressurized fluid at point 50. Fluid passing along the hydraulic fluid discharge line 30 then reaches point 42 where the pressure control means intersects to control the pressure of the fluid which will reach tong 12, thereby controlling the torque.

The velocity control means operates on a pressure compensated concept. Hydraulic fluid moving along hydraulic fluid return means 34 passes through valve 100 and then emerges from valve 100 over line 110, 112 or 114. Fluid moving along either line 110 or 112 enters double check valve 115 and exits through line 118. Fluid moving along line 114 which enters line 116 along with the fluid passing along 118 enters double check valve 119 and emerges along on line 120. Line 120 carries the hydraulic fluid back to valve 104 at a point where the valve also has a positive spring pressure element by pilot spring 122 in order that the internal pressure of valve 104 by way of back pressure is the sum of the pressure of the hydraulic fluid on line 120 plus the spring bias pressure 122. A portion of the initial stream of hydraulic fluid entering valve 104 passes along line 124 where it enters line 114 at point 126. The fluid on line 114 is connected with line 28 which returns the fluid to the reservoir 14.

In the embodiment shown in FIG. 1, both valves 100, 104 are preferably continuously variable spool valves. The velocity control means operates on the back-pressure compensation concept. This concept permits the use of minimum effort on the spool of valve 100 and provides excellent spool metering. As a result of the return flow through line 120 and the spring valve 122 combined with the flow into the upper end of the valve 104 through line 125 a pressure balancing effect is created. As the spool in valve 100 restricts flow therethrough, pressure builds up in lines 125 and 106 until at a predetermined pressure the spool in valve 104 begins to shift to maintain a predetermined pressure drop across the spool of valve 104 and balance the forces acting on valve 100. Relief valve 130 is provided between line 120 and line 114.

It will, therefore, be appreciated that the embodiment of the invention illustrated in FIGS. 1 through 3 is adapted to provide a continuous stream of hydraulic fluid at a number of predetermined pressure levels so as to effect maximum control over the speed and torque of operation of the power tong. All of this is accomplished in an economical fashion which provides for simple operator control through lever 56. It also provides the ability to preset valve 100 through lever 102 as well as valves 60, 62, 64 without need for the operator to be involved with these latter settings.

Figure 4:
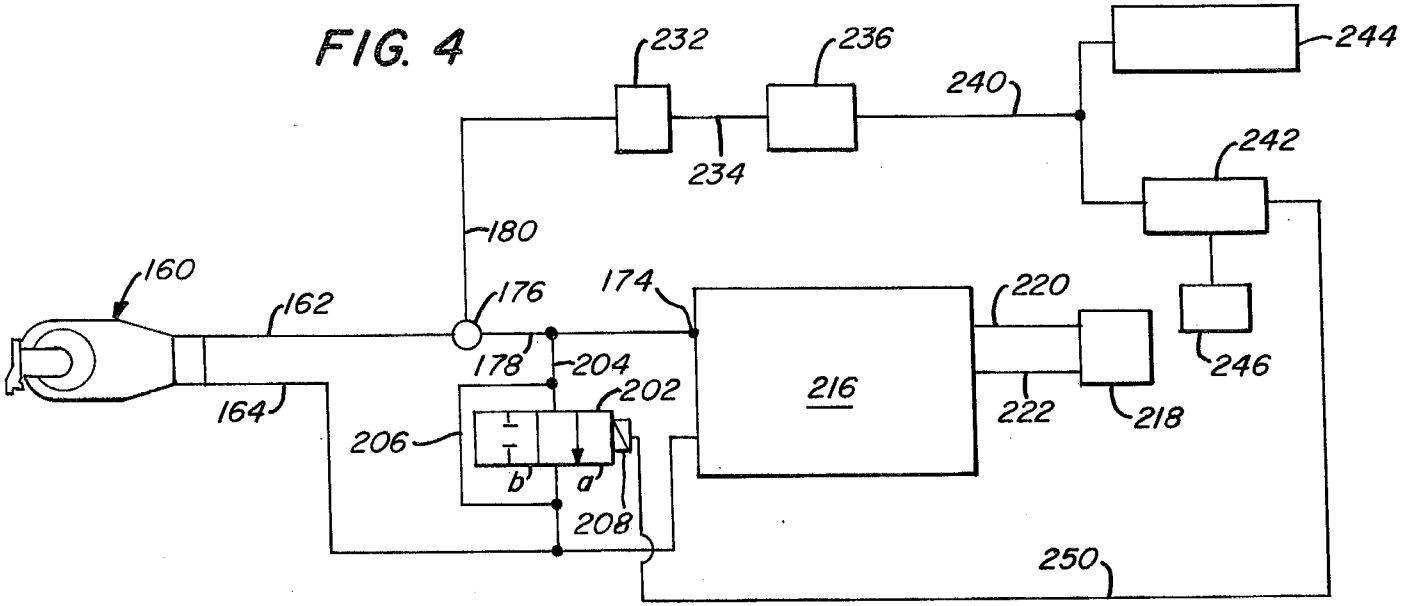
FIG. 4 is a schematic illustration of another embodiment of the invention.

Referring now to FIG. 4 another embodiment of the invention will be considered. In this embodiment a tong 160 is supplied with pressurized hydraulic fluid on line 162 and returns the fluid by means of line 164. Velocity control means 216 (which may be of the form illustrated in FIG. 1) receives pressurized fluid from reservoir 218 over line 220 and returns the same through line 222. The velocity control means 216 determines the output velocity of the hydraulic pressurized fluid at point 174. Downstream of point 174 is a pressure transducer 176 which is connected to hydraulic lines 178, 180. Electrical lead 180 is adapted to transport an electrical signal related to the pressure of the hydraulic fluid passing adjacent transducer 176. The electrical signal is introduced into analog-digital converter 232 wherein it is converted to a binary signal and is carried by electrical lead 234 to computer means 236. The computer means 236 contains information regarding pipe, coupling or other item's properties such as pipe makeup specifications. This computer means 236 is adapted at a particular setting to emit a signal along electrical lead 240 which signal is introduced into comparator 242. Also shown in this view is an optional visual display 244 wherein digital readout of the quantitative figure may be provided. The comparator is provided with a preset portion 246 which may contain a multiplicity of thumb wheels, for example, permitting predetermined pressure level settings to be made for a variety of stages of operation such as that provided by the three valves 60, 62, 64 of the FIG. 1. When the comparator 242 receives a signal indicating the pressure has exceeded the preset valve, a signal is emitted over electrical lead 250 to move the four-way valve 202 to a position "a" which permits flow along hydraulic line 204 from hydraulic line 178 to hydraulic line 164 and from there back to reservoir 218 through velocity control means 216. The valve 202 would normally be in position "b" which precludes flow along line 204 to line 164. A bleeder line 206 is provided to minimize valve chatter. Coil 208 activates valve 202 to create the desired position. It may be desirable to provide a further analog-digital converter in line 250 depending upon the nature of the comparator output.

It will be appreciated that while certain specific embodiments have been illustrated and described herein with a view toward describing the best mode of practicing the present invention, variations and alternate means will occur to those skilled in the art. For example, in lieu of using return lines from the tong 12 in FIG. 1, one might substitute other means for the pressure compensating system. Also, while specific reference has been made to use of the system in connection with the control of the preferred oil well power tong, it will be appreciated that the system may be readily employed to operate hydraulic fluid motors, hydraulic cylinders and other similar mechanisms.

Whereas particular embodiments of the invention have been described above for purposes of illustration it will be evident to those skilled in the art that numerous variations of the details have been made without departing from the invention as defined in the appended claims.

I claim:

1. Power tong apparatus comprising hydraulic fluid control apparatus and a drill string power tong with said hydraulic fluid control apparatus having hydraulic fluid entry means for receiving hydraulic fluid, hydraulic fluid discharge means for supplying pressurized hydraulic fluid, said hydraulic fluid discharge means includes means for supplying said pressurized hydraulic fluid to said power tong and hydraulic fluid return means for receiving pressurized fluid returning from said power tong to said hydraulic fluid control apparatus, velocity control means cooperating with said hydraulic fluid entry means for establishing a desired predetermined velocity for the hydraulic fluid, pressure control means cooperating with said hydraulic fluid discharge means for selectively limiting the exit pressure of said hydraulic fluid through said discharge means to predetermined levels, said pressure control means including valve means adapted to divert pressurized fluid from said hydraulic fluid discharge means when the pressure thereof exceeds one of two or more predetermined levels, said valve means includes at least two valves adapted to be set at different said predetermined pressure levels, valve control means for selectively setting the position of said valve means to establish a said predetermined pressure level in said hydraulic fluid discharge means, and said valve control means includes a three-position valve.

2. Power tong apparatus comprising hydraulic fluid control apparatus and a drill string power tong with said hydraulic fluid conrol apparatus having hydraulic fluid entry means for receiving hydraulic fluid, hydraulic fluid discharge means for supplying pressurized hydraulic fluid, said hydraulic fluid discharge means includes means for supplying said pressurized hydraulic fluid to said power tong and hydraulic fluid return means for receiving pressurized fluid returning from said power tong to said hydraulic fluid control apparatus, velocity control means cooperating with said hydraulic fluid entry means for establishing a desired predetermined velocity for the hydraulic fluid, pressure control means cooperating with said hydraulic fluid discharge means for selectively limiting the exit pressure of said hydraulic fluid through said discharge means to predetermined levels, said pressure control means including valve means adapted to divert pressurized fluid from said hydraulic fluid discharge means when the pressure thereof exceeds one of two or more predetermined levels, said valve means includes at least two valves adapted to be set at different said predetermined pressure levels, valve control means for selectively setting the position of said valve means to establish a said predetermined pressure level in said hydraulic fluid discharge means, said valve means having a first valve adapted to be set within a first pressure range, a second valve adapted to be set within a second pressure range having an upper limit higher than the range of said first pressure valve and a third valve adapted to be set within a third pressure range with an upper limit higher than the range of said first valve, said valve control means including a three position valve, and said valve control means including manual control means adapted to establish the desired positin of said three position valve.

* * * * *